US008708530B2

(12) United States Patent
Pollack, Jr.

(10) Patent No.: US 8,708,530 B2
(45) Date of Patent: Apr. 29, 2014

(54) LIGHTING FIXTURE

(75) Inventor: George P. Pollack, Jr., Oak Brook, IL (US)

(73) Assignee: Eastco Corporation, Oak Lawn, IL (US)

( * ) Notice: Subject to any disclaimer, the term of this patent is extended or adjusted under 35 U.S.C. 154(b) by 260 days.

(21) Appl. No.: 13/105,980

(22) Filed: May 12, 2011

(65) Prior Publication Data

US 2011/0280021 A1 Nov. 17, 2011

Related U.S. Application Data

(60) Provisional application No. 61/334,905, filed on May 14, 2010.

(51) Int. Cl.
*F21V 29/02* (2006.01)
*F21V 29/00* (2006.01)

(52) U.S. Cl.
USPC ..... 362/294; 362/264; 362/308; 362/373

(58) Field of Classification Search
USPC ..... 362/264, 294, 308, 362, 373
See application file for complete search history.

(56) References Cited

U.S. PATENT DOCUMENTS

| | | | | |
|---|---|---|---|---|
| 4,321,659 | A * | 3/1982 | Wheeler | 362/293 |
| 4,546,420 | A * | 10/1985 | Wheeler et al. | 362/268 |
| 4,939,374 | A * | 7/1990 | Greutert | 250/504 R |
| 7,380,965 | B2 * | 6/2008 | Nakashita | 362/373 |
| 2003/0185012 | A1 * | 10/2003 | Sitzema et al. | 362/328 |
| 2005/0243539 | A1 * | 11/2005 | Evans et al. | 362/84 |

* cited by examiner

*Primary Examiner* — Karabi Guharay
*Assistant Examiner* — Nathaniel Lee
(74) *Attorney, Agent, or Firm* — Drinker Biddle & Reath LLP

(57) ABSTRACT

A lighting fixture with a housing having an opening and containing a fan and at least one heat-generating light bulb to produce light at the opening and a protective lens assembly below the housing opening. The protective lens assembly includes a top clear or translucent lens and a bottom clear or translucent lens having an opening and spaced from the top lens to provide a first ventilation gap between the lenses while protecting the interior of the housing. The fan may be operated to cool the light bulb by moving air through the ventilation gap and across the bulb.

19 Claims, 5 Drawing Sheets

LIGHTING FIXTURE

CROSS-REFERENCE TO RELATED PATENT APPLICATIONS

This patent application claims the benefit of U.S. Provisional Patent Application No. 61/334,905 filed May 14, 2010.

FIELD OF THE INVENTION

This invention pertains to lighting fixtures structured to dissipate heat from hot-running light bulbs and ballasts mounted in the fixtures and to prevent debris from unintentionally escaping from the fixtures.

BACKGROUND

Lighting fixtures used in gymnasiums or other sporting arenas, factories and other high-bay lighting applications or environments often contain hot-running light bulbs. These light bulbs produce a substantial buildup of heat in the lighting fixtures that can damage componentry including ballasts, refractors, housings, etc. The heat build up can also cause premature failure of the light bulbs. Because these fixtures are typically mounted well out of easy reach, maintenance is extremely difficult, so long life of the fixture and light bulbs is extremely desirable.

Oftentimes, such fixtures are provided with safety thermostats that cut off power to the light bulbs if certain safety limit temperatures are exceeded. While this may prevent damage to the fixtures and premature bulb failure, it is obviously undesirable since the lighted gymnasium, factory, etc. will go partially or completely dark in such circumstances.

Embodiments of the present invention prevent heat buildup in such lighting fixtures without interfering with the normal and expected appearance or operation of the lighting fixtures. They thereby improve fixture reliability and bulb longevity and minimize the chances of safety shut-off due to fixture overheating. Embodiments of the present invention also prevent the unintentional escape of debris from the lighting fixtures.

DETAILED DESCRIPTION

Figure 1:
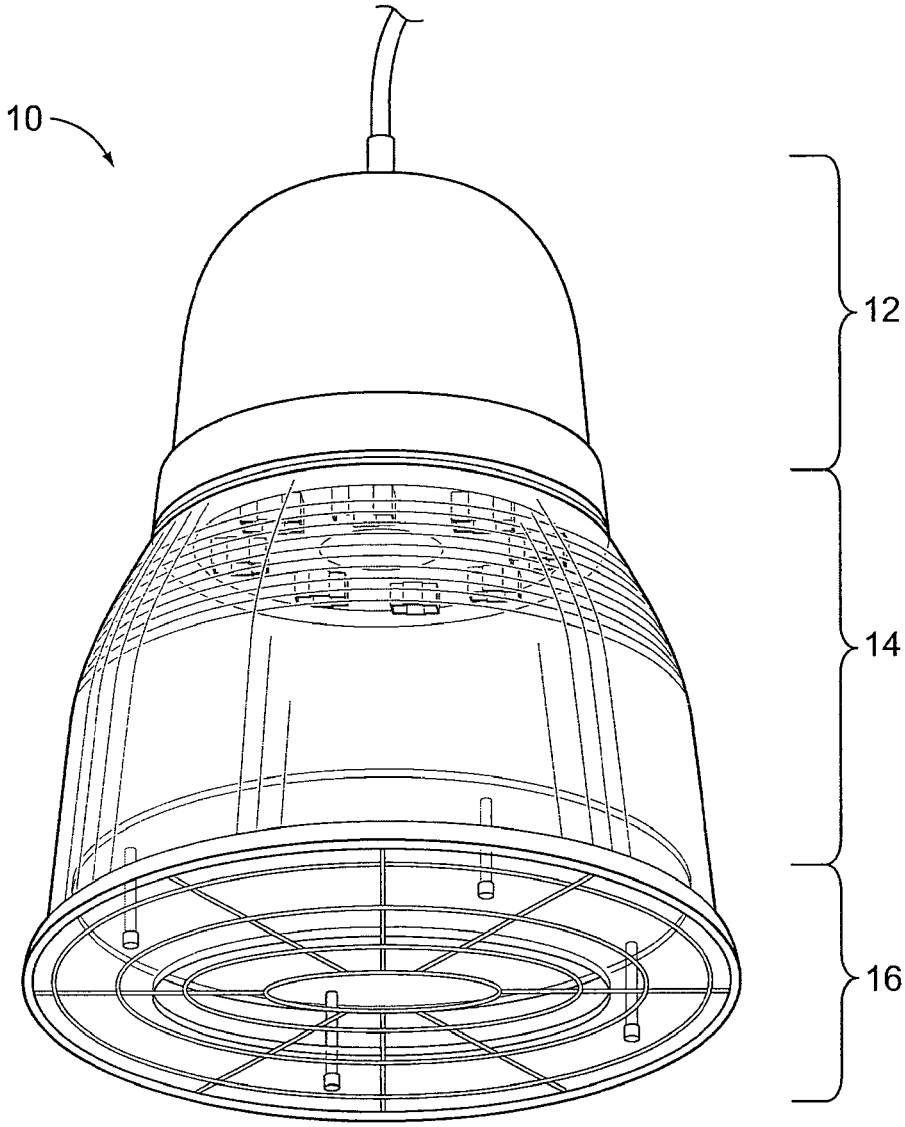
FIG. 1 is a perspective view of a fully assembled lighting fixture in accordance with an embodiment of the present invention.

Turning first to FIG. 1, a lighting fixture 10 of an embodiment of the invention is illustrated in a perspective view. Fixture 10 is intended primarily for mounting in gymnasiums or other sporting arenas, factories and other high bay lighting applications or environments, or in any other indoor applications where preferably ceiling mounting heights exceed about 15 feet.

Fixture 10 includes a housing 12 with a housing opening 11 and a refractor 14 fitted to the housing opening. In alternate embodiments, the refractor may not be used and an enlarged housing may extend beyond the light bulbs 15.

Figure 2:
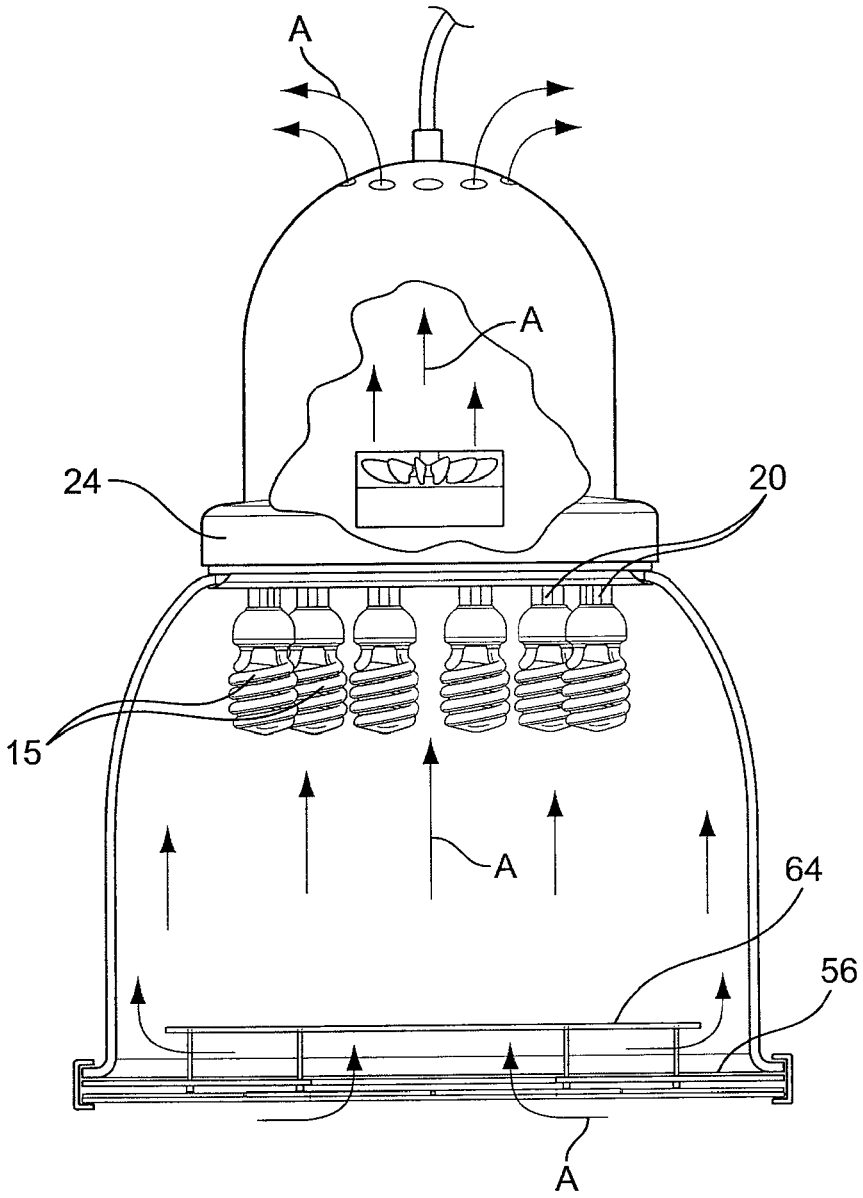
FIG. 2 is a cutaway elevation front view of the lighting fixture of FIG. 1.
Figure 3:
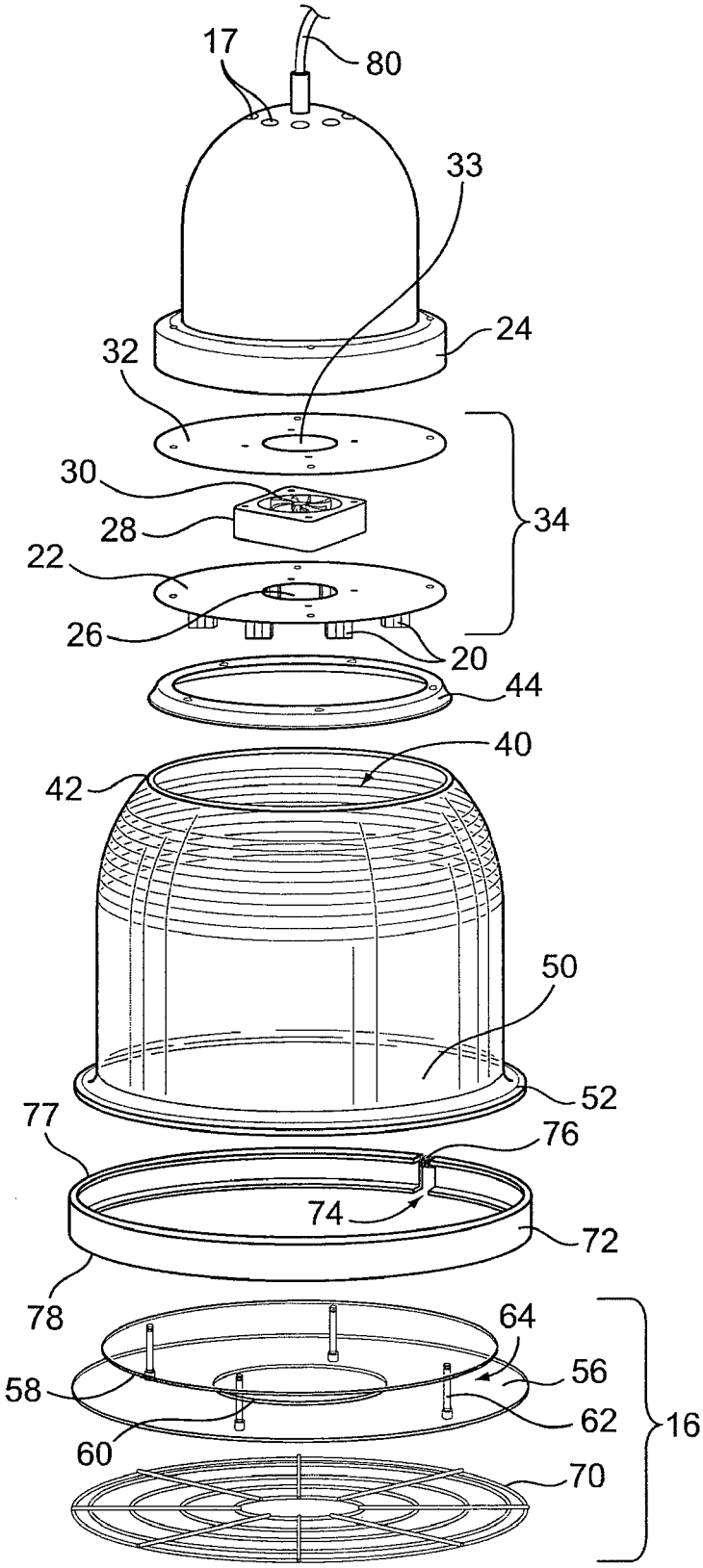
FIG. 3 is an assembly drawing illustrating the components of the lighting fixture of FIG. 1.
Figure 4:
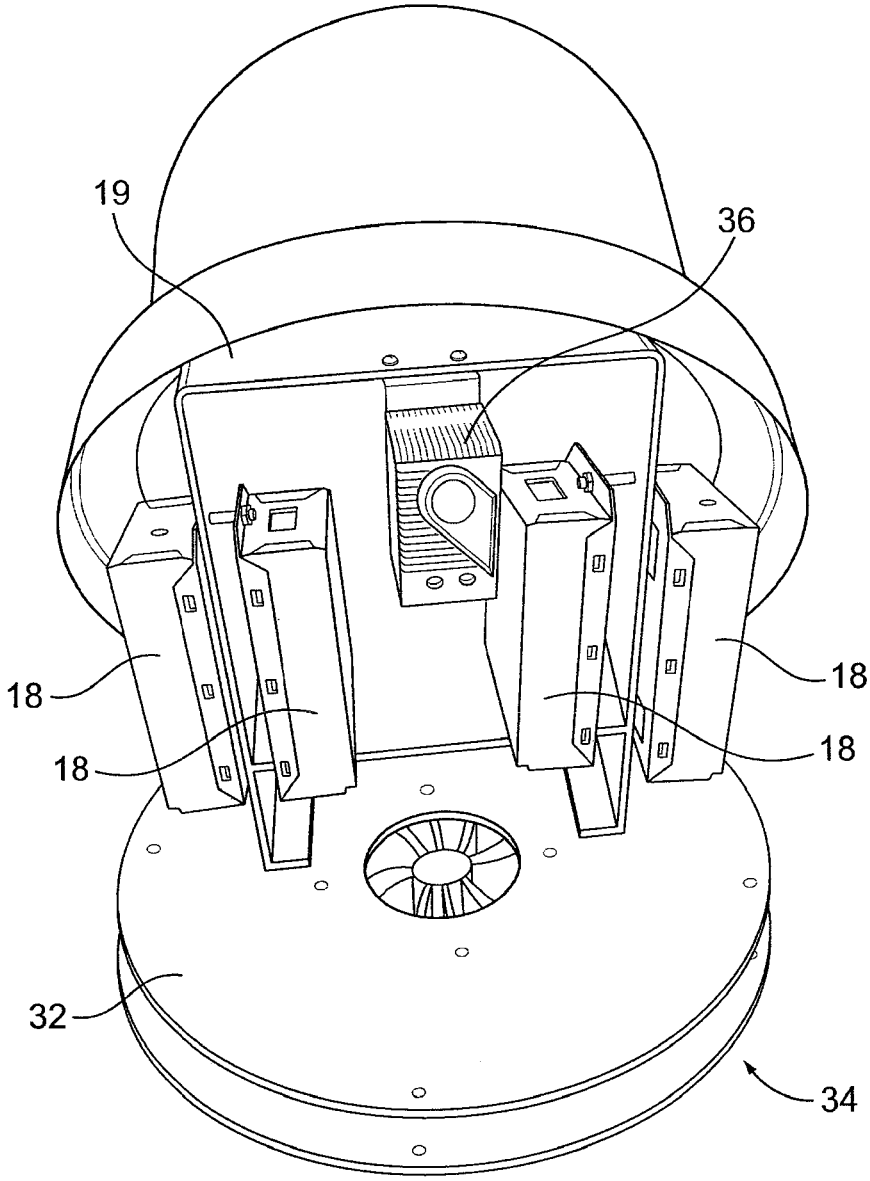
FIG. 4 is a view of componentry located with the housing of the lighting fixture of FIG. 1.

As shown in FIGS. 2-4, housing 12 contains ballast components 18 for powering bulbs 15 and wiring (not shown) electrically connected to a series of lighting sockets 20 mounted on a circular lighting socket plate 22. The lighting sockets preferably are arranged in a circular pattern on lighting socket plate 22 which is removably affixed to the underside of the bottom circular collar 24 of housing 12 and above the housing opening 11. Although bulbs 15, which are shown in place in the sockets in FIG. 2, are compact fluorescent light bulbs, other types of bulbs could be used. The bulbs produce light below housing opening 11.

A second circular plate 32 of the same diameter as plate 22 is located above the axial fan and attached to plate 22 by a series of spacers (not shown) about its periphery. Plate 32 has a central aperture 33 aligned with aperture 26 and of approximately the same diameter as aperture 26. The fan is therefore sandwiched between plates 22 and 32 to form a fan/socket assembly 34.

A thermostat 36 may be mounted above ballasts 18 by bracket 19 which is affixed to the top of plate 32. Ballasts 18 are spaced apart as shown to facilitate airflow and hence cooling by the fan. The thermostat may be set to a predetermined temperature (e.g., 130° C.) to warn of imminent fixture failure due to overheating, for example by lighting a warning light or tripping an alarm (not shown).

Refractor 14 has a proximal opening 41 and a distal opening 50 and is positioned with its proximal opening 41 at housing opening 11. When refractor 14 is clear or translucent, some of the light produced by bulbs 15 is projected through the refractor. The proximal opening 41 at the top of refractor 40 is encircled by an annular edge 42. A circular retaining plate 44 is designed to sit below edge 42 to removably affix the refractor to housing 12 with the fan/socket assembly positioned in collar 24 at the bottom of housing 12. The distal annular opening 50 of the refractor is encircled by an annular collar 52. This collar facilitates attachment of a protective lens assembly 16.

Protective lens assembly 16 is positioned at the distal opening 50 of the refractor. As noted above, the protective lens assembly may be mounted within an enlarged housing when a refractor is not used. Lens assembly 16 comprises a bottom circular flat lens 56 and a top circular flat lens 59. While it is preferred that the bottom lens have a larger diameter than the top lens, both lenses may be of the same diameter or the bottom lens may have a smaller diameter than the top lens.

Although bottom lens 56 is illustrated with an axially positioned circular opening 60 which is preferably larger than the diameter of openings 26 and 33, other opening shapes may be used and the opening(s) need not be centrally located. Lenses 56 and 59 are spaced from each other by pins 62 which are arranged along the periphery of lens 59 and are attached at either end to the two clear or translucent lenses, forming a first ventilation gap 64. While any appropriate spacing could be used, the spacing preferably will be no greater than about one inch. The combination of lenses blocks direct access to the interior of the housing so that, inter alia, (1) objects cannot move into the fixture from below and damage components within the fixture; and (2) components within the fixture cannot fall through the lens assembly and escape the fixture.

The outer edge of top lens 58 is spaced from the border of the distal opening 50 of the refractor to form a second ventilation gap 55 allowing an air stream A to pass between the edge of the top lens 58 and the border of the distal opening 50 of the refractor (as shown in FIG. 2). In an alternative embodiment, the outer edge of the top lens 58 may be spaced from the border of the housing opening 11 to form a second ventilation gap allowing air stream A to pass between the edge of the top lens 58 and the border of the housing opening 11.

A protective wire grid 70 is located below bottom lens 56 to protect the lens and the interim of the fixture from damage for example in a gymnasium or athletic arena setting. The wire grid also protects people below the lighting fixture, like the lens assembly, from debris that might come loose in the fixture, for example, from a broken light bulb.

Finally, an annular flexible locking band 72 with an opening 74 held together by a spring 76 and top and bottom annular lips 77 and 78 is provided to capture and hold the lens assembly and the protective grid at the bottom of the refractor along collar 52.

Once in place, the lens assembly facilitates air flow through the fixture to prevent it from overheating while also preventing any broken light bulbs or other debris from escaping the fixture and falling onto spectators or others disposed below the fixture.

Figure 5:
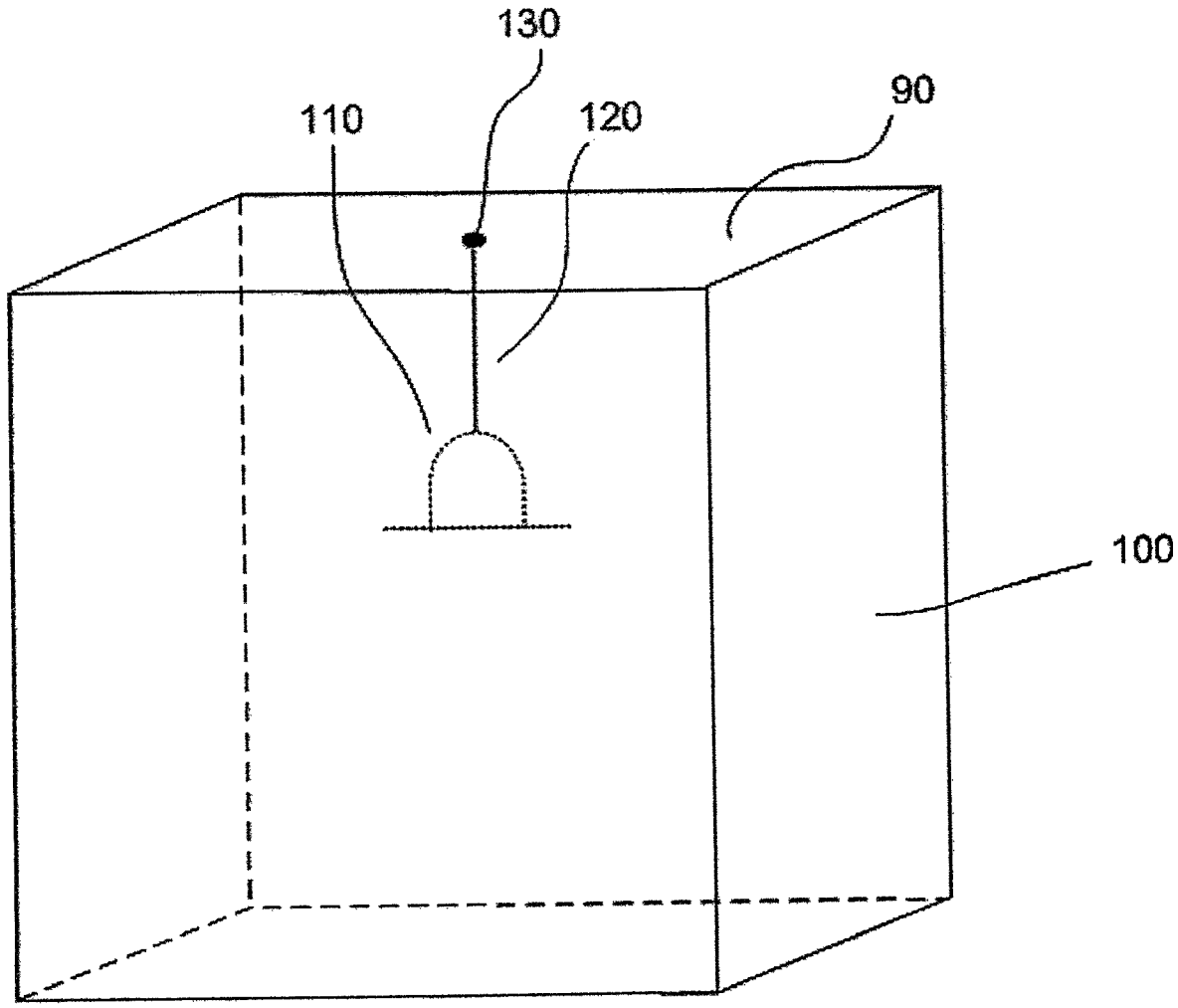
FIG. 5 is a diagrammatic representation of a lighted facility including a lighting fixture in accordance with an embodiment of the present invention.

FIG. 5 shows a diagrammatic representation of a lighting facility 100 according to an embodiment of the invention. The facility uses at least one lighting fixture 102 as described above attached at a powered junction 104 via a cord 106 to at least one upper supporting section (ceiling) 108. Any number of such lighting fixtures could be mounted within facility 100. Lighting fixture 102 projects light generally downwardly towards the floor of the facility 110. Facility 100 may be a gymnasium or arena designed for athletic play and optimally for spectators (not shown). The facility may have stands for holding spectators and/or courts, grounds, or otherwise designated areas for competitive sporting events.

Lighting fixture 10 operates as follows:

1. First it is assembled and positioned where desired, typically by hanging from a ceiling by a cord 80 which includes the necessary electrical wiring (not shown) to supply current to the ballasts of the fixture. The assembled fixture will contain bulbs 15 ready to be lighted when current is supplied by a ballast or other current source.
2. Once the fixture is lighted, illumination is provided both from the sides through acrylic refractor 14 and through lens assembly 16.
3. At the same time, power is provided to fan 30 causing fan blades 32 to begin rotating. The fan blades are oriented to produce an upward flow of an airstream A which is drawn through opening 60 in bottom lens 56 and the spacing 64 between the top and bottom lenses (the first ventilation gap), the spacing between the edge of the top lens and the exterior of the fixture (the second ventilation gap) and then through apertures 26 and 33 in plates 22 and 32 before passing through orifices 17 at the top of the housing. Thus, as airstream A moves past light bulbs 15, it cools them in the process and prevents overheating of the overall lighting fixture.

Thus, the invention makes it possible to move air through the fixture to cool it without impairing its ability to prevent debris from escaping through the bottom of the lighting fixture while also safeguarding the interior of the fixture.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A lighting fixture comprising:

a housing having an opening and containing a fan and at least one heat-generating light bulb to produce light at the opening;

a protective lens assembly positioned below the housing opening, the protective lens assembly including a top clear or translucent solid lens and a bottom clear or translucent lens having a central opening for passing air into the protective lens assembly, the bottom lens being spaced from the top lens to provide a first ventilation gap between the lenses while protecting the interior of the housing; and a transparent refractor having proximal and distal openings positioned with its proximal opening at the housing opening, the protective lens assembly being positioned with the bottom lens of the assembly at the distal opening of the refractor and the outer edge of the top lens spaced from the border of the distal opening of the refractor to form the second ventilation gap, whereby the fan may be operated to cool the light bulb by moving air through the central opening in the bottom lens to the first and second ventilation gaps and across the bulb.

2. The lighting fixture of claim 1 wherein:

the housing has at least one ventilation orifice to facilitate air movement through the housing.

3. The lighting fixture of claim 1 wherein:

the housing has at least one heat-generating ballast and the fan cools the ballast by moving air through the ventilation gap and across the ballast.

4. The lighting fixture of claim 1 wherein:

the housing opening and the bottom lens opening are circular and in axial alignment and the ventilation gap comprises an annular opening.

5. The lighting fixture of claim 4 wherein:

the bottom clear or translucent lens has a centrally located circular opening to facilitate the movement of air through the lens assembly.

6. The lighting fixture of claim 1 wherein:

the refractor is made of acrylic resin.

7. The lighting fixture of claim 1 including:

a thermostat in the housing for determining whether a predetermined temperature is reached; and a warning light or alarm electrically connected to the thermostat, whereby the warning light or alarm is electrically triggered if the thermostat exceeds the predetermined temperature.

8. A cooled and protected lighting fixture comprising:

a housing having an opening, and containing a fan, at least one heat-generating light bulb to produce light at the opening;

a transparent or translucent refractor having proximal and distal openings positioned with its proximal opening at the housing opening; and a protective lens assembly positioned at the distal opening of the refractor and disposed across the housing opening, the protective lens assembly including a bottom clear lens at the distal end of the assembly having a central opening and spaced from a top clear lens to provide a first ventilation gap between the lenses while blocking direct access to the interior of the housing, the top lens having an outer edge spaced from the border of the distal opening of the refractor to form a second ventilation gap encircling the top lens, whereby the fan may be operated to cool the light bulb by moving air through the opening in the bottom lens to the first and second ventilation gaps and across the bulb.

9. The lighting fixture of claim 8 wherein:

The housing opening and the bottom lens opening are circular and in axial alignment and the first gap comprises an annular opening.

10. The lighting fixture of claim 9 wherein:

the bottom clear or translucent lens has a centrally located circular opening to facilitate the movement of air through the lens assembly.

11. The lighting fixture of claim 8 wherein:

the refractor is made of acrylic resin.

12. The lighting fixture of claim 8 wherein:

the housing has at least one ventilation orifice.

13. The lighting fixture of claim 8 including:

a thermostat in the housing for determining whether a predetermined temperature is reached; and a warning light or alarm electrically connected to the thermostat, whereby the warning light or alarm is electrically triggered if the thermostat exceeds the predetermined temperature.

14. A lighted facility comprising:

an at least partially enclosed space having an upper supporting section; and at least one lighting fixture attached to the supporting section, the lighting fixture including (1) a housing having a light opening and containing a fan and at least one heat-generating light bulb to produce light at the light opening; and (2) a protective lens assembly below the housing opening, (3) the protective lens assembly including a top clear or translucent solid lens and a bottom clear or translucent lens having a central opening for passing air into the protective lens assembly, the bottom lens being spaced from the top lens to provide a first ventilation gap between the lenses while protecting the interior of the housing, and a transparent refractor having proximal and distal openings positioned with its proximal opening at the housing opening, the protective lens assembly being positioned with the bottom lens of the assembly at the distal opening of the refractor and the outer edge of the top lens spaced from the border of the distal opening of the refractor to form the second ventilation gap encircling the top lens, (4) whereby the fan may be operated to cool the light bulb by moving air through the central opening in the bottom lens to the first and second ventilation gaps and across the bulb.

15. The lighted facility of claim 14 wherein the facility is a gymnasium or arena designed to hold athletes or spectators.

16. The lighted facility of claim 14 wherein the cooled and protected lighting fixture has at least one ventilation orifice to facilitate air movement through the housing.

17. The lighted facility of claim 14 wherein the housing of the cooled and protected lighting fixtures has at least one heat-generating ballast and the fan cools the ballast by moving air through the ventilation gap and across the ballast.

18. The lighted facility of claim 14 wherein the housing of the cooled and protected lighting fixtures light opening and the bottom lens opening are circular and in axial alignment and the first ventilation gap comprises an annular opening.

19. The lighted facility of claim 14 wherein the housing of the cooled and protected lighting fixture has a transparent or translucent refractor having proximal and distal openings with its proximal opening at the fixture light opening; and the protective lens assembly positioned at the distal opening of the refractor with the outer edge of the top lens spaced from the border of the distal opening of the refractor to form the first ventilation gap.

* * * * *